US005125352A

United States Patent [19]

Shields

[11] Patent Number: 5,125,352

[45] Date of Patent: Jun. 30, 1992

[54] BOAT HULL WITH BOTTOM SLOPING UPWARDLY AND REARWARDLY BETWEEN SPONSONS

[76] Inventor: John E. Shields, 21881 Winnebago La., Lake Forest, Calif. 92630

[21] Appl. No.: 609,263

[22] Filed: Nov. 6, 1990

[51] Int. Cl.[5] ..... B63B 1/00

[52] U.S. Cl. ..... 114/56

[58] Field of Search ..... 114/56, 67, 61, 288, 114/290, 291

[56] References Cited

U.S. PATENT DOCUMENTS

| | | | |
|---|---|---|---|
| 3,930,455 | 1/1976 | Bremer | 114/56 |
| 4,091,761 | 5/1978 | Fehn | 114/290 |
| 4,378,747 | 4/1983 | Beatty et al. | 114/56 |
| 4,924,797 | 5/1990 | Solia | 114/291 |

*Primary Examiner*—Jesus D. Sotelo
*Attorney, Agent, or Firm*—William W. Haefliger

[57] ABSTRACT

A longitudinally extending boat hull having a forwardly tapering nose section and an aft end section that extends laterally comprising the hull being substantially V-shaped in cross section from the nose section rearwardly at least to about ⅓ the hull length extending rearwardly from the nose section; the hull having two laterally spaced downwardly projecting sponsons that diverge rearwardly from a position at least about half the hull length to the aft end section, each of the sponsons increasing in lateral width in a rearward direction; and the hull having a bottom that extends rearwardly generally between the sponsons the hull bottom including a portion that slopes relatively upwardly and rearwardly between the sponsons along at least about the rearwardmost 1/5 of the length of the hull.

9 Claims, 3 Drawing Sheets

BOAT HULL WITH BOTTOM SLOPING UPWARDLY AND REARWARDLY BETWEEN SPONSONS

BACKGROUND OF THE INVENTION

This invention relates generally to boat hull configurations, and more particularly to an improved hull design or configuration which provides multiple advantages in terms of low drag, high stability, and high maneuverability. The invention enables location of the drive unit at a more shallow location resulting in better protection of the propeller, less drag induced by the drive appendage, a more efficient drive, and enhanced stability. The invention is applicable to a wide variety of boat types, such as pleasure crafts, racing boats, bass boats, cruisers, etc.

Attempted match-ups, as between racing boat hulls, and engine and propeller drives, has resulted in provision of various shaped hull cross sections. These are characterized by "flat hull bottom", hull "V-bottom", the so-called "tri-hull", and "cathedral hull", hulls with "tunnel" bottoms, and a hull "V-bottom" between two tunnels. Such hulls have certain advantages and disadvantages. The latter include boat handling roughness, as in choppy water, and lessened maneuverability.

There is a need for an improved hull that minimizes such disadvantages, and offers lo-drag, high stability, as during maneuvering, and handling ease.

SUMMARY OF THE INVENTION

It is a major object of the invention to provide an improved hull meeting the above need. As will appear, the hull has a forwardly tapering nose or fore section, and an aft end section that extends laterally, and includes:

a) the hull being generally V-shaped in cross section from the nose section rearwardly at least to about $\frac{1}{3}$ the boat length extending rearwardly from the nose section, b) the hull having two laterally spaced downwardly projecting sponsons that diverge rearwardly from a position at least about half the boat length to the aft end section, each of the sponsons increasing in lateral width in a rearward direction, c) and the hull having a bottom portion that extends rearwardly between the sponsons and that slopes rearwardly and relatively upwardly between the sponsons at about the rearwardmost 1/5 of the length of the hull.

Further, the major length of the hull bottom typically has downwardly projecting shallow, V-shaped projecting cross sections, which increase in shallowness rearwardly to merge with the hull bottom portion that slopes upwardly and rearwardly, thereby providing well-defined sponsons at the aft end of the hull. Also, the water flow tunnel between the sponsons enlarges in a rearward direction to reduce water flow relative velocity at the propeller location enabling better "bite" of the propeller.

Another object is to provide sponsons that are alike and increase in lateral width as well as height, in a rearward direction; and the two sponsons merge with the V-shaped forward configuration of the hull for enhancing maneuverability.

Another object is to provide a new split-vee hull design that has special features not found on the deep-vee or shallow-vee hull designs. These special features include a substantial reduction in appendage drag, increased stability, static and running, and a goodly number of additional safety features.

Yet another object is to lessen the appendage drag from which present hull configurations suffer greatly. Such appendage drag is attributed primarily to the drive unit, including housing, shaft, struts, and propeller housing.

A further object is to provide a hull configuration which permits power units to be raised considerably toward the water surface, thus eliminating a deeply submerged power unit which creates excessive drag causing great losses of efficiency and propeller protection.

Other features of the invention contribute to safety with regards to stability, construction strength attributed to the corrugated hull design, plus overall maneuverability.

These and other objects and advantages of the invention, as well as the details of an illustrative embodiment, will be more fully understood from the following specification and drawings, in which:

DRAWING DESCRIPTION

DETAILED DESCRIPTION

Figure 3:
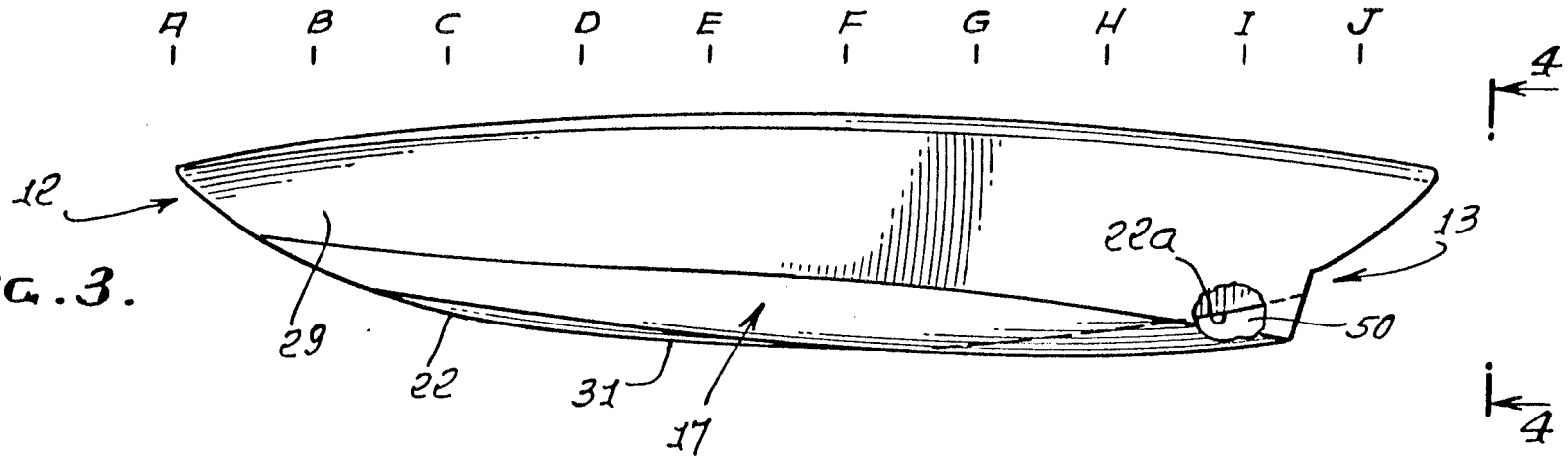
FIG. 3 is a side elevation taken on lines 3—3 of FIG. 1.

In the drawings, the boat 10 has a hull 11 that extends longitudinally and has a forwardly tapering fore or nose section 12, and aft end section 13 that extends laterally. The hull is substantially V-shaped in cross section from the nose section rearwardly at least to about $\frac{1}{3}$ the hull length (i.e., between station A and about Station D in FIG. 3) extending rearwardly from the nose section.

Figure 6:
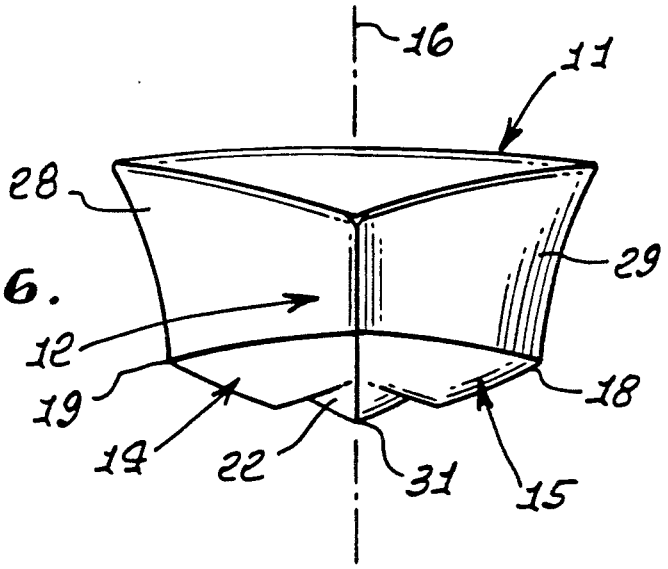
FIG. 6 is a frontal view of the hull.

The hull has two laterally spaced, downwardly projecting sponsons 14 and 15 that are alike in mirror image relation, relative to vertical longitudinal plane 16 seen in FIG. 6. The two sponsons diverge rearwardly, as is clear from FIG. 2, from a position or positions forward of the boat midsection 17, i.e., they extend for at least half the hull length to terminate at the aft section 13, i.e., at locations 14*a* and 15*a*. The sponsons have side walls 14*b* and 14*c*, 15*b* and 15*c*, and bottom walls 14*d* and 15*d*, as shown. In forward direction, the sponsons generally merge with the V-shape of the hull, forwardly of the hull midsection, i.e., the bottom walls 14*d* and 15*d* take on increasing slope, in a forward direction, and the sponsons' outer side walls 14*b* and 15*b* are eliminated, that is, they form chines 18 and 19 adjacent the bottom wall.

The sponsons inner side walls 14*c* and 15*c* have maximum height at the hull rear section; and they gradually decrease in height in a forward direction to form chines 20 and 21 with the hull bottom 22, forwardly of the hull midsection.

The hull bottom 22 extends rearwardly generally between the sponsons, as for example between about station B or C over to station J. It has generally downwardly projecting shallow, V-shaped cross sections along the major length of the hull and slopes downwardly and rearwardly, as for example between stations B or C to station G or H, the V-shape shallowness increasing in rearward direction until it becomes generally horizontally flat at station H or I, and continues flat to station J. At station B or C the hull bottom has about the sam sharp V-shaped angularity as the hull side walls 28 and 29, and sponson bottom walls, at those stations. Note that between about stations B and F, the downward apex 31 of the hull bottom V-shape projects below the lowermost levels of the two sponsons.

Figure 5:
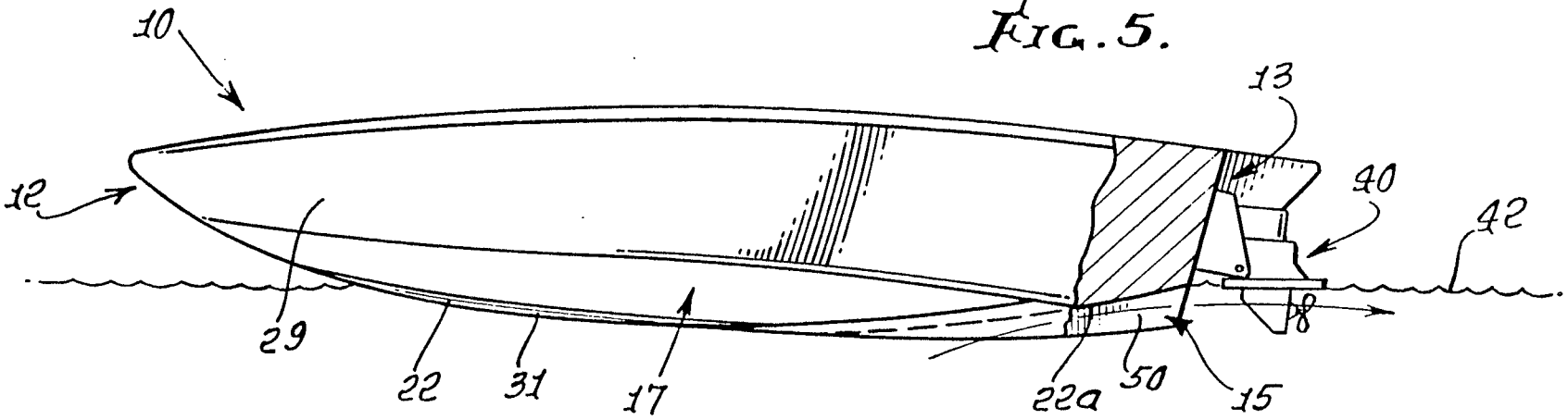
FIG. 5 is a view like FIG. 3, but showing a drive unit attached to the rear transmission of the hull, and the boat hull then tilted upwardly.
Figure 4:
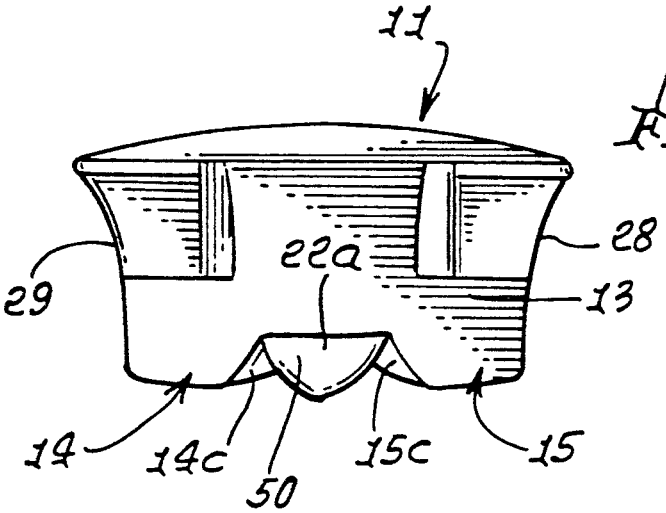
FIG. 4 is an end elevation taken on lines 4—4 of FIG. 3.

An important aspect of the invention concerns the provision of a hull bottom rearwardmost portion 22*a* that slopes upwardly and rearwardly between and relative to the sponsons, along at least about the rearwardmost 1/5 of the length of the hull (say between stations G and J. Such upwardly sloping increases, in a rearward direction, as the flatness of the bottom increases (V-shape decreases to form a water flow tunnel 50 of increasing height and width, rearwardly). Several advantages accrue from this construction:

1) The sponsons are thereby increasingly well-defined in a rearward direction, enhancing boat hull stability; and the water flowing relatively through the tunnel 50 decreases in relative velocity as the tunnel enlarges, providing maximum "bite" for the propeller at the aft end of the tunnel.
2) The hull maintains a single V-shape at its forwardmost extents.
3) As the boat tilts upwardly due to weight of the propellers and engine drive 40, as seen in FIG. 5, the bottom rearward portion 22*a* extends at or near horizontal, i.e., generally parallel with water level 42, so as to minimize drag as the water flows relatively past and in contact with the under surface of portion 22*a;* the two sponsons at their well-defined rearwardmost extents then providing maximum stability.
4) The sponsons have increasing vertical dimension, rearwardly, relative to said bottom wall portion, for stability.

Figures 1, 2:
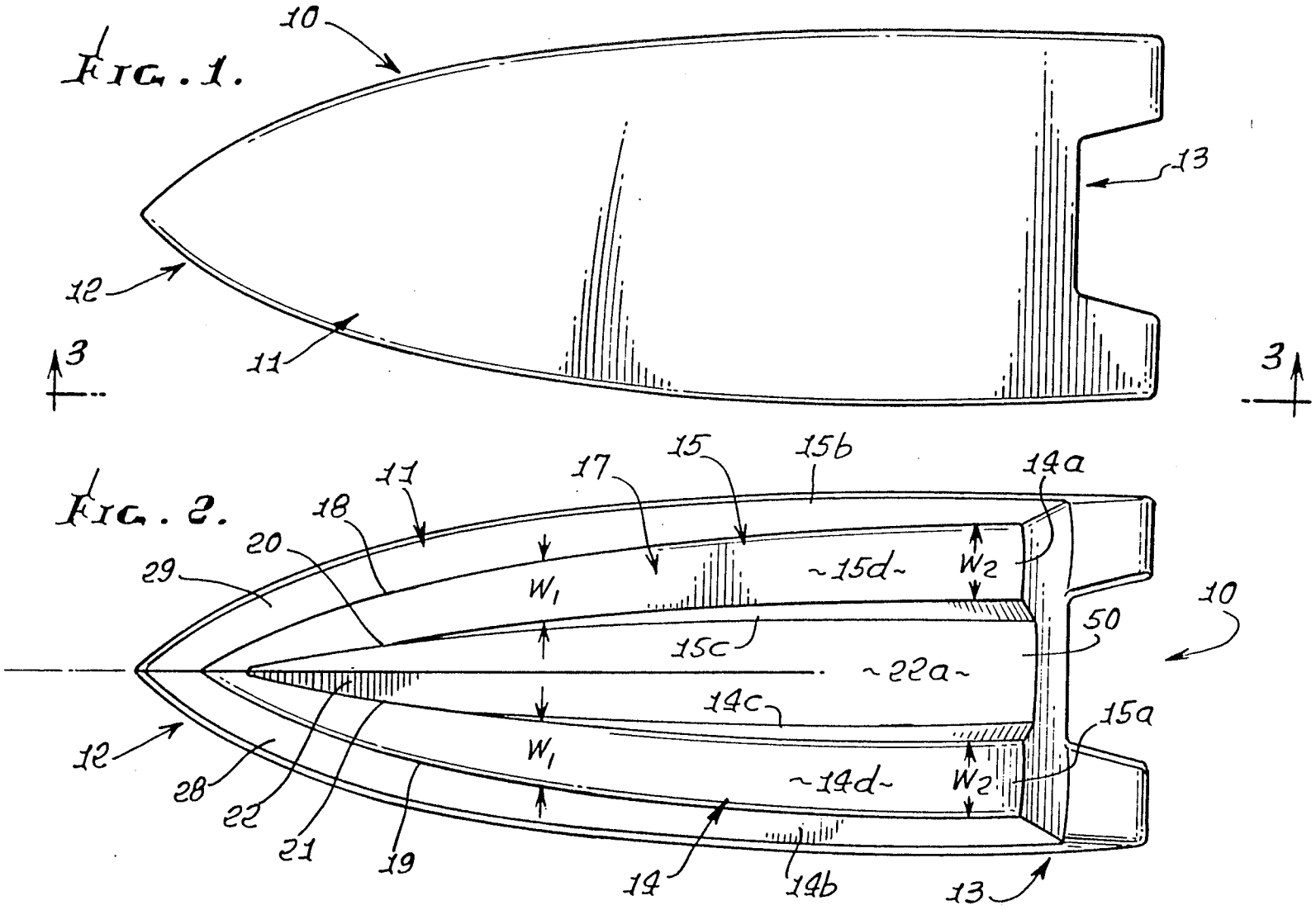
FIG. 1 is a top plan view showing a hull outline of a boat incorporating the invention.
FIG. 2 is a bottom plan view of the FIG. 1 boat hull.

It will be further noted that the two sponsons increase in lateral width "w", as seen in FIG. 2; note in this regard that forward widths $w_1$ are less than rearward widths $w_2$ as shown; and the sponsons taper, arcuately, in a forward direction, both toward one another, and also as respects their individual bottom wall widths.

Note further that, as seen in FIG. 5, the propeller and appendage are located directly rearwardly of the tunnel 50 exit, so as not to project beneath the bottom levels of the sponsons. Safety is thereby enhanced. The water passing through the tunnel 50 is led directly to the propeller for maximum efficiency.

I claim:

1. In a longitudinally extending boat hull having a forwardly tapering nose section and an aft end section that extends laterally, the combination comprising a) the hull being substantially V-shaped in cross section from said nose section rearwardly at least to about ⅓ the hull length extending rearwardly from said nose section,
b) the hull having two laterally spaced downwardly projecting sponsons that diverge rearwardly from a position at least about half the hull length to said aft end section, each of said sponsons increasing in lateral width in a rearward direction, said sponsons narrowing in width toward said nose section and merging at said nose section, said sponsons having under surfaces that increasingly slope upwardly and laterally, away from the hull, at and along the sponson lengths proceeding forwardly toward said nose section to merge with the V-shape of the hull, and said sponsons increasingly converging forwardly along these lengths, and toward said nose section,
c) and said hull having a bottom that extends rearwardly generally between said sponsons said hull bottom including a portion that slopes relatively upwardly and rearwardly between said sponsons along at least about the rearwardmost 1/5 of the length of the hull.

2. The combination of claim 1 wherein the major length of said hull bottom has downwardly projecting, shallow, V-shaped cross section.

3. The combination of claim 2 wherein said V-shaped hull bottom cross section increases in shallowness, rearwardly, to merge with said hull bottom portion that slopes rearwardly and relatively upwardly.

4. The combination of claim 1 wherein said hull portion that slopes rearwardly and relatively upwardly is substantially flat at its rearwardmost extent.

5. The combination of claim 3 wherein said hull portion that slopes rearwardly and relatively upwardly is substantially flat at its rearwardmost extent.

6. The combination of claim 1 wherein said sponsons are alike and increase in lateral width in a rearward direction, the sponsons having flat bottoms at that rearward location.

7. The combination of claim 6 wherein said hull has chines that define laterally outermost extents of the sponsons along their lengths.

8. The combination of claim 1 including an engine and propeller drive attached to the hull at its rearwardmost extent, the hull then tilting upwardly in the water and said hull bottom portion that slopes relatively upwardly being generally horizontal.

9. In a longitudinally extending boat hull having a forwardly tapering nose section and an aft end section that extends laterally, the combination comprising, a) the hull being substantially V-shaped in cross section from said nose section rearwardly at least to about ⅓ the hull length extending rearwardly from said nose section,
b) the hull having two laterally spaced downwardly projecting sponsons that diverge rearwardly from a position at least about half the hull length to said aft end section, each of said sponsons increasing in lateral width in a rearward direction, said sponsons having under surfaces that increasingly slope upwardly and laterally, away from the hull, at and along the sponson lengths proceeding forwardly toward said nose section to merge with the V-shape of the hull, and said sponsons increasingly converging forwardly along these lengths, and toward said nose section,
c) and said hull having a bottom that extends rearwardly generally between said sponsons said hull bottom including a portion that slopes relatively upwardly and rearwardly between and relative to said sponsons along at least about the rearwardmost 1/5 of the length of the hull,
d) the major length of said hull bottom having downwardly projecting, shallow, V-shaped cross section, e) said V-shaped hull bottom cross section increasing in shallowness, rearwardly, to smoothly merge with said hull bottom portion that slopes rearwardly and relatively upwardly, f) and wherein said V-shaped hull bottom defines an apex that extends rearwardly and downwardly below the level of the sponsons at and along the mid $\frac{1}{3}$ of the hull length.

* * * * *